US005523735A

United States Patent [19]

Goseberg et al.

[11] Patent Number: 5,523,735

[45] Date of Patent: Jun. 4, 1996

[54] HIGH TENSION LINE TRANSFORMER FOR A TELEVISION RECEIVER

[75] Inventors: Walter Goseberg; Hane-Werner Sander; Rolf Heidrich, all Hanover, Germany

[73] Assignee: Deutsche Thomson Brandt GmbH, Villingen-Schwenningen, Germany

[21] Appl. No.: 100,420

[22] Filed: Aug. 2, 1993

[30] Foreign Application Priority Data

| | | | |
|---|---|---|---|
| Aug. 4, 1992 | [DE] | Germany | 42 25 692.5 |
| Jan. 13, 1993 | [DE] | Germany | 43 00 624.8 |
| Jun. 23, 1993 | [DE] | Germany | 42 20 714.6 |

[51] Int. Cl.[6] ..... H01F 27/30

[52] U.S. Cl. ..... 336/208; 336/196; 336/199

[58] Field of Search ..... 336/196, 199, 336/208

[56] References Cited

U.S. PATENT DOCUMENTS

| | | | |
|---|---|---|---|
| 4,623,754 | 11/1986 | Kikuchi et al. | 174/52 R |
| 5,225,803 | 7/1993 | Negle et al. | 336/208 |

FOREIGN PATENT DOCUMENTS

| | | | |
|---|---|---|---|
| 3151642 | 4/1983 | Germany | H04N 5/657 |
| 4039373 | 6/1992 | Germany | H01F 31/00 |
| 1249716 | 8/1986 | U.S.S.R. | H04N 3/195 |

*Primary Examiner*—Laura Thomas
*Attorney, Agent, or Firm*—J. S. Tripoli; F. A. Wein

[57] ABSTRACT

A high voltage transformer for a television receiver includes a coil former supporting a primary winding on a magnetic core. The primary winding has an axial length L. A compartmentalized coil former supports a high voltage coil radially surrounding the primary winding. The high voltage coil has a radial outer diameter D with the ratio of L/D being less than one. A plurality of diodes are supported by the compartmentalized coil former and connect the high voltage coils in series. The diodes are supported on the compartmentalized coil former at substantially the same axial position and are equally spaced about the periphery of the compartmentalized coil former.

12 Claims, 5 Drawing Sheets

HIGH TENSION LINE TRANSFORMER FOR A TELEVISION RECEIVER

This invention is directed to a high tension (voltage) line transformer for a color television receiver.

In high tension transformers used in color television sets, high frequency oscillations, which are caused by stray inductances and stray capacitances and are transmitted into the primary circuit, occur in the high tension circuit at the beginning of the lines when the high tension rectifying diodes are no longer conductive. Since the line deflection coils are not completely decoupled from the transformer by a switching transistor, which is conductive during the one half of the forward sweep, and from a fly back diode, which is conductive during the other half of the forward sweep, harmonic currents having a high frequency relative to the line frequency occur in the line deflection current at the beginning of the lines. These harmonics lead to so-called curtaining effects at the upper edge of the picture. In addition, the harmonics cause losses in the winding and the ferrite core of the transformer. Moreover, because of their high frequency, the harmonics act as spurious radiation sources on the signal processing stages of the television receiver when operating at low signal levels.

It is known that the amplitude of these harmonics can be reduced by connecting a so-called Ri-circuit into the path of the operating voltage to the line output stage. This consists of a parallel, damped oscillatory circuit which is tuned to the frequency of the harmonics. The Ri-circuit forms a trap for these frequencies so that the amplitude of the harmonics in the line deflection current is reduced. An Ri-circuit of this type is expensive, however, especially because it has to be constructed for the full operating current of the line output stage. It is an object of the invention to construct a high tension line transformer in such a way that the amplitude of the harmonics occurring in the line deflection current is reduced to a tolerable amount without the use of the described oscillatory circuit.

Thus, in essence, the invention resides in a novel type of geometrical dimensioning of the high tension transformer. While, with known high tension transformers, the ratio of the total length L of the windings in the axial direction to the outer diameter D of the high tension winding is distinctly greater than 1(L/D>1), with the transformer in accordance with the invention the ratio is designed to be distinctly smaller than 1 (L/D<1). In contrast to a transformer which is long in the axial direction with a contrastingly small diameter, a transformer is produced that is relatively short in the axial direction and that has a comparatively greater outer diameter. Initially this dimensioning may appear disadvantageous, for the following reason. Due to the shorter length of the construction in the axial direction, the total number of the chambers for holding the high tension winding is necessarily reduced e.g. from 16 to 9. Nevertheless, the total number of turns must remain the same for the achievement of the predefined high tension. This means, that the number of turns per chamber rises i.e. the individual chambers are wound more fully. The self-capacitance of the winding present in a chamber is thereby increased. In turn, the resonant frequency of each winding is thereby reduced so that, now for example, tuning of the high tension winding to only 13 H is possible, where H is the line frequency, but tuning to 21 H is no longer possible. Nevertheless, due to the reduced resonant frequency, the amplitude of the harmonics is again increased according to the Fourier principle. Consequently, initially it would seem that the new construction of the transformer would cause the amplitude of the interfering harmonics in the line deflection current to increase. Surprisingly, however, the amplitude of the harmonics does not increase but rather is decreased considerably. The reason for this surprising result is that in addition to the winding capacitance of each high voltage winding present in a chamber, there is also a coupling capacitance effective between each high voltage winding and the primary winding. This coupling capacitance is not significantly changed by the construction in accordance with the invention. However, the total number of chambers is considerably diminished due to the reduced axial length e.g. from 15 to 9 chambers. Consequently, the sum of the coupling capacitances between a respective high voltage winding in a chamber and the primary winding is diminished. The total effective capacitative coupling between the high voltage winding and the primary winding is thus reduced. This means, that the total effective influence of the secondary winding on the primary winding is correspondingly reduced. This influence is however decisive as to the extent to which the harmonics produced in the secondary winding due to resonance are coupled into the line deflection current. Since the capacitive influence of the secondary winding on the primary winding is considerably reduced by the invention, the amplitude of the harmonics in the line deflection current is also correspondingly diminished. Consequently, a transformer in which, without any appreciable expenditure, a considerable reduction of the interfering harmonics in the line deflection current results. The reduction is sufficiently greater that the previously used Ri-circuit in the path of the line deflection current which can be omitted. Thus, in a surprising manner, the described disadvantage caused by the reduced magnetic coupling between the secondary winding and the primary winding is over compensated by the surprising advantage of the reduced total effective capacitive coupling between these windings.

Newer types of high voltage transformers utilizing the split diodes principle for high voltages in the order of 30–35 kV require a plurality of approximately, 12 to 15 high voltage rectifying diodes which are axially arranged over the walls of the chambers in the coil former. Due to the short axial length of the coil former in accordance with the invention, it can be difficult to accommodate this number of diodes on the coil former. This difficulty is overcome by the feature that several, for example, four, diodes are arranged over the periphery at the same respective axial position on the compartmentalized coil former. By means of this solution, there are no difficulties in accommodating the necessary number of diodes with a coil former that is short in the axial direction. Such a solution is described more fully in the earlier application P 41 29 678.

In accordance with a further development of the invention, the space between the upper edge of the primary winding and the lower edge of the secondary winding is constructed, to the extent possible, to be free of electrical fields. In this manner, the dielectric losses due to displacement currents are considerably reduced. A space free of electrical fields can be achieved by poling and distributing the primary winding and the secondary winding such that pulses of approximately the same amplitude and polarity occur in the regions of the windings facing each other. In order to ensure that the pulses at the upper edge of the primary winding of the coil former have an amplitude which is substantially equal to the amplitude of the pulses at the bottom of the high voltage winding, the primary winding is preferably divided into a plurality of layers that are radially superimposed. The operating voltage is supplied to the primary winding at the lower end, i.e. the end facing the core, in order that the primary winding conveys at the outermost periphery a pulse voltage that is as similar as possible in amplitude, frequency and phase to the pulse voltage at the base of the high voltage winding. A high voltage transformer including a space free of electrical fields between the primary winding and the secondary winding of this type is described more fully in the DE-OS 40 39 673.

The invention is explained with reference to the drawings in which.

Figure 1:
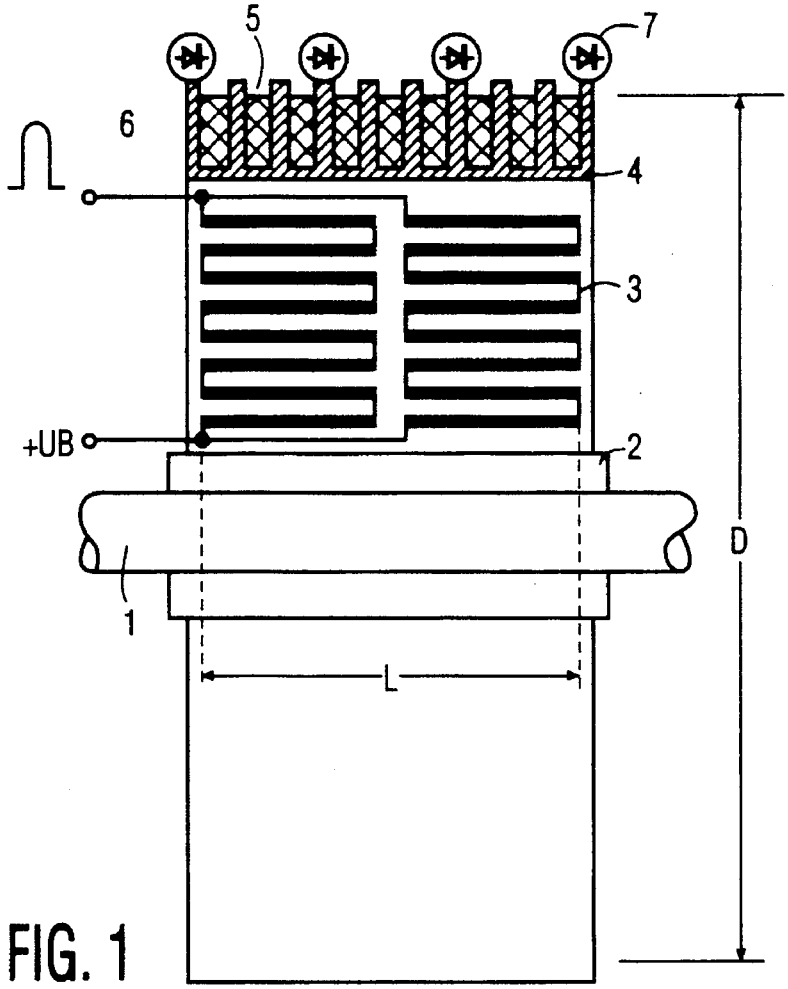
FIG. 1 shows a section through a high voltage transformer in accordance with the invention.
Figure 3:
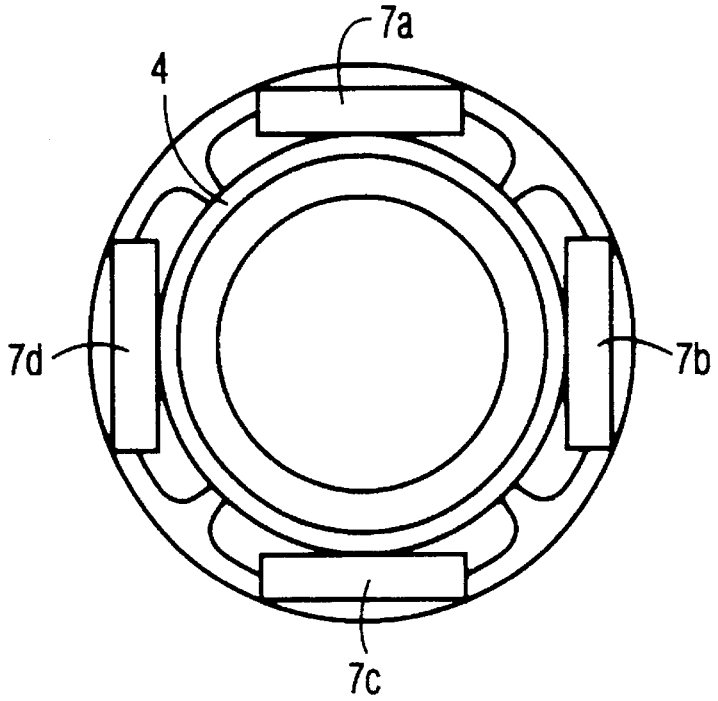
Figure 4:
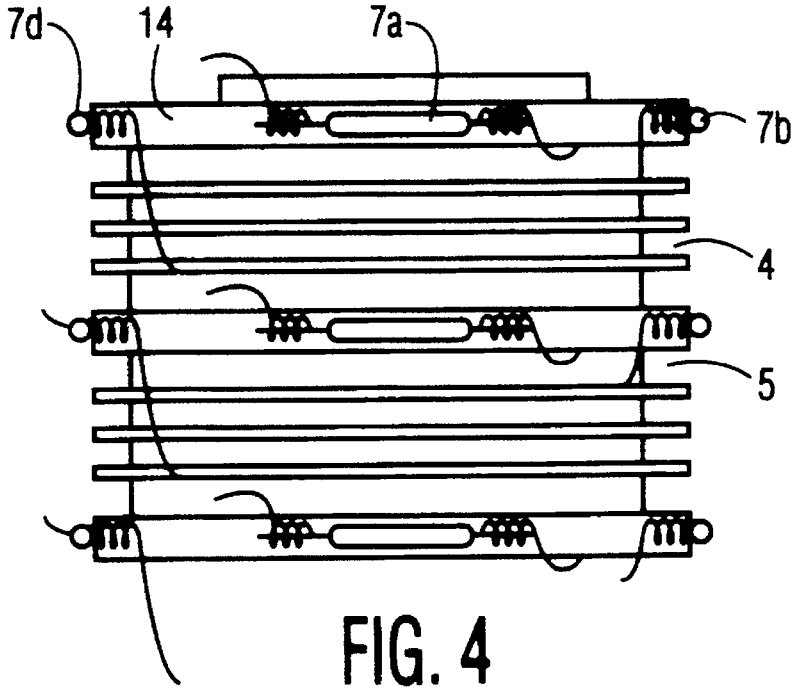

FIG. 3 an arrangement of the high tension rectifying diodes in a side view of FIG. 1 and FIG. 4 is a top view of a transformer in accordance with FIG. 3.

Figure 5:
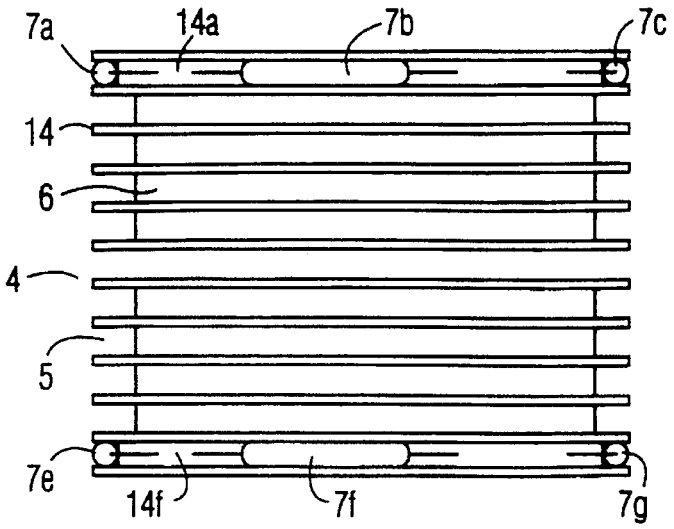

FIG. 5 is another preferred embodiment.

Figure 6:
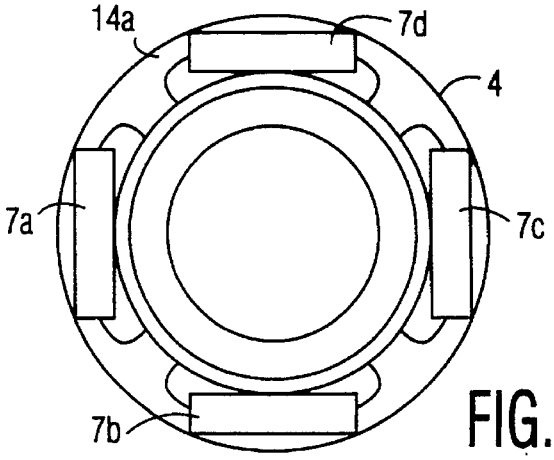

FIG. 6 shows the disposition of the diodes on the former.

Figure 7:
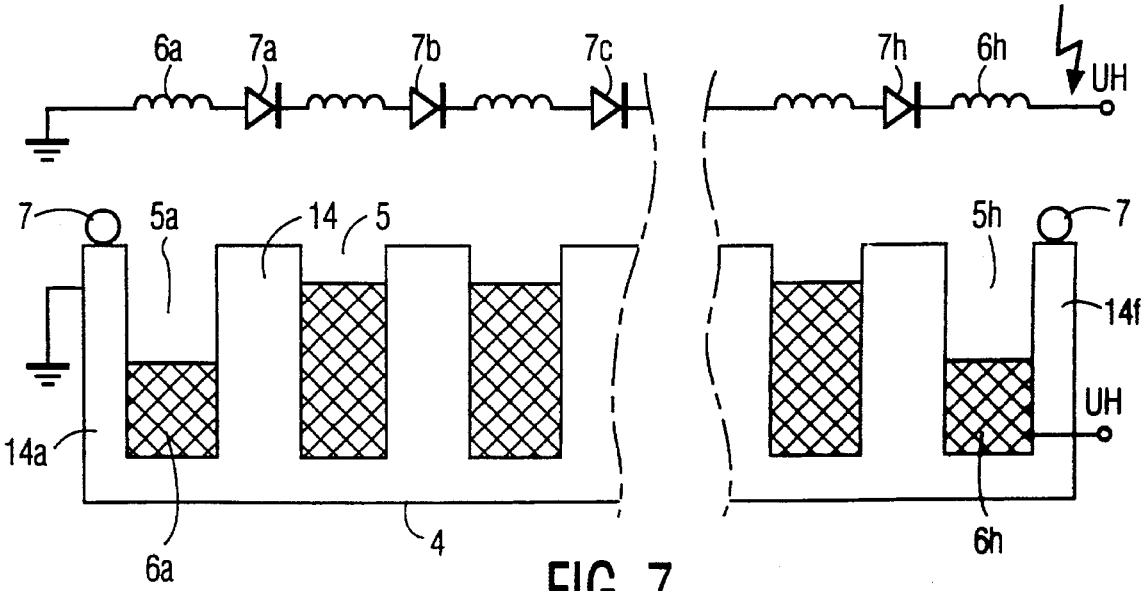

FIG. 7 is an enlarged showing of the coil former.

Figure 8:
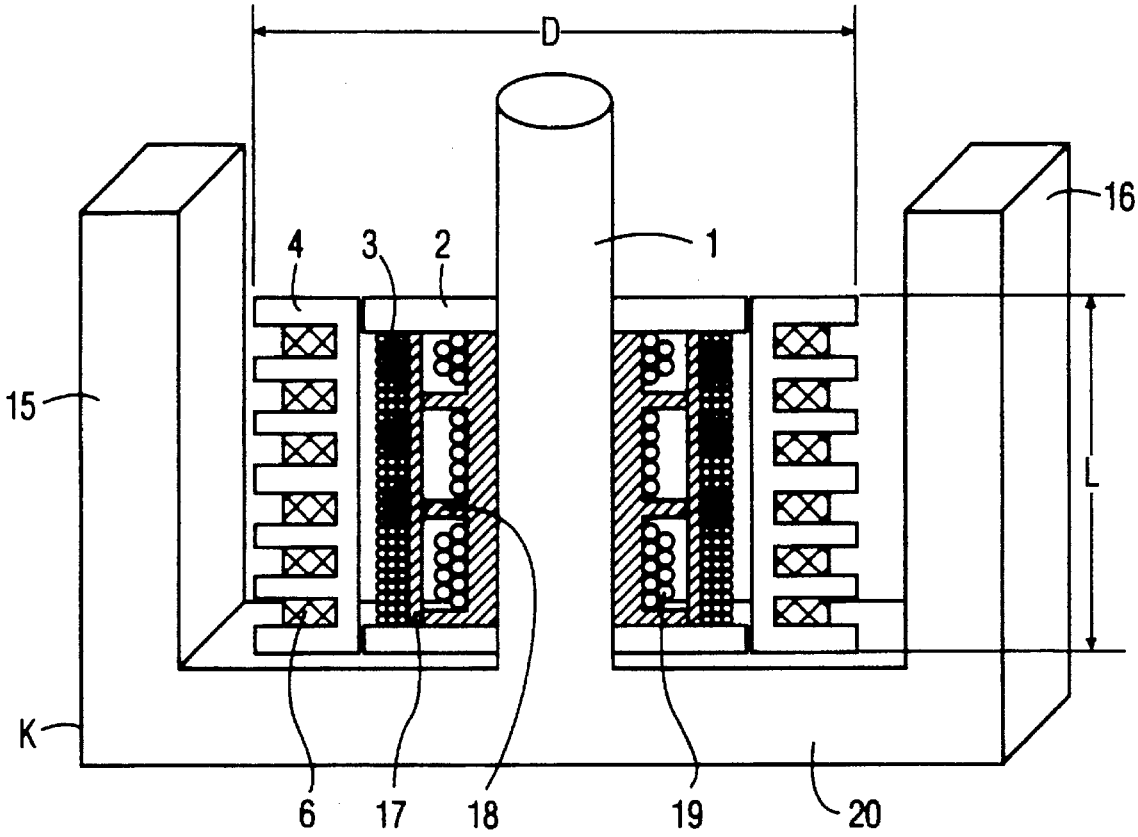

FIG. 8 shows ferrite core configuration.

Figure 9:
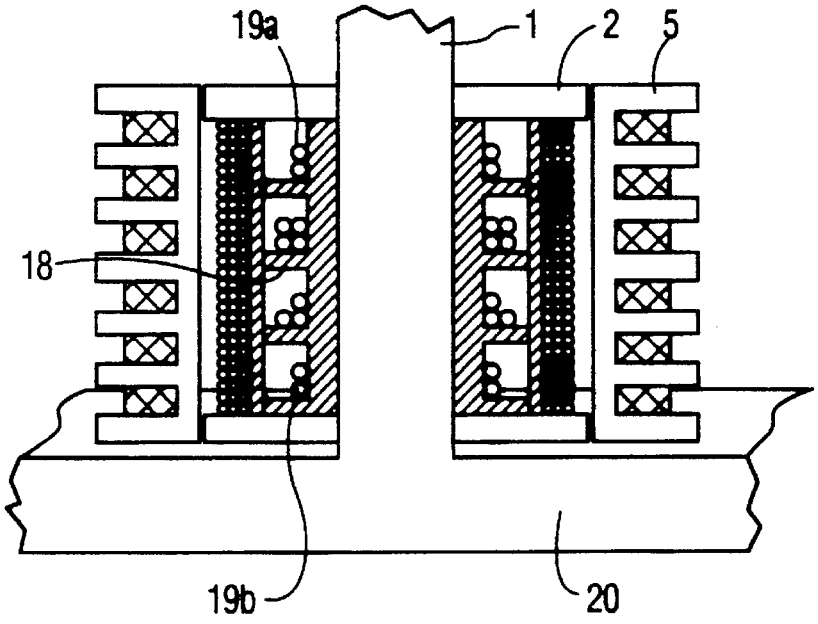

FIG. 9 shows a coil former which enables accurate frequency tuning.

FIGS. 10 to 14 show various core configurations.

In FIG. 1, a high voltage transformer for a television receiver includes a core 1, a coil former 2 for a primary winding 3, a compartmentalized coil former 4 for a high voltage winding 6 which is arranged in chambers 5 of the coil former 4. High voltage rectifying diodes 7 which are interconnected with the high tension winding 6 according to the split diodes principle, are arranged over the walls of the coil former 4. The primary winding 3 comprises two parallel connected layered windings each having 8 layers that are located one behind the other in the axial direction.

The ratio of the axial length L of the windings 3 and 6 to the outer diameter D of the winding 6 is designed to be smaller than 1 and lies in the order of magnitude of 0.5 to 0.85. Due to the short axial dimension but high radial diversion, the total effective coupling capacitance between the primary winding 3 and the high voltage winding 6 is greatly reduced. As already described, this is based upon the fact that the number of chambers 5, whose windings each form a specific coupling capacitance with the primary winding, is considerably diminished. The total surface area between the secondary winding 6 and the primary winding 3, which determines the total coupling capacitance between the windings, is considerably reduced in comparison to known transformers. Due to the reduced total capacitive coupling, the amplitude of the capacitive currents, which generates the amplitude of the unwanted harmonics produced in the line deflection current, is also correspondingly reduced.

Figure 2:
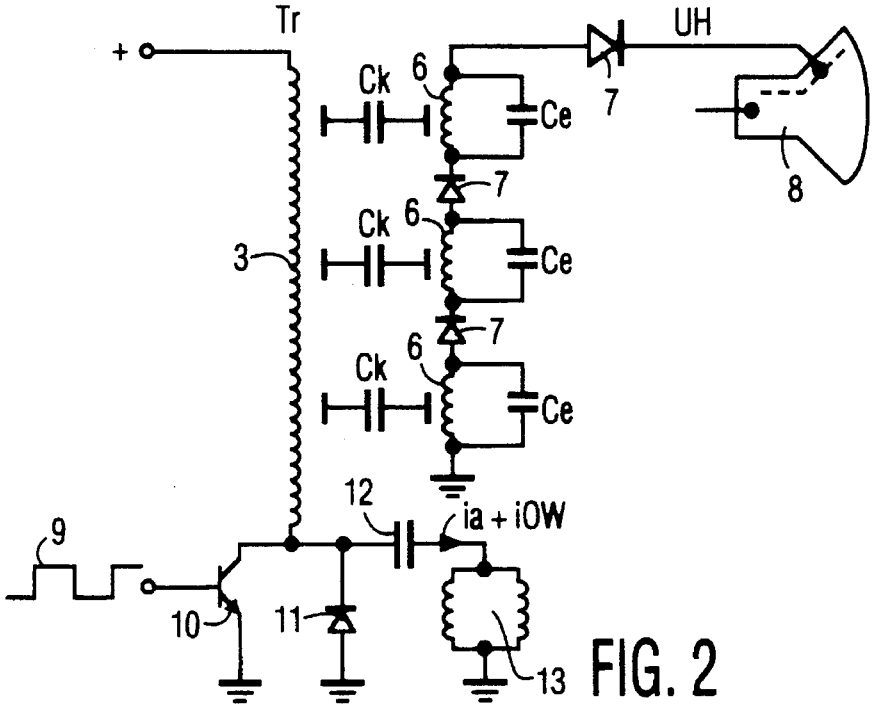
FIG. 2 is an equivalent circuit useful in understanding the operation of the invention.

FIG. 2 shows an equivalent circuit useful in understanding the operation of the invention. A line deflection transformer Tr includes a primary winding 3 and high voltage windings 6, which each lie in a chamber 5 in accordance with FIG. 1. In practice, about 6–10 of such types of high voltage windings are provided. The high voltage rectifying diodes 7 are located in series with the windings 6. The generated high voltage UH is supplied to the picture tube 8. Also illustrated are, a switching transistor 10 controlled by the line frequency switching voltage 9, a fly back diode 11, a tangential capacitor 12 and line deflection coils 13. The line deflection current ia with superimposed high frequency harmonics ioW flows through the deflection coils 13. Each high voltage winding 6 together with its winding capacitance Ca forms an oscillatory circuit which is tuned to an odd numbered harmonic of the line frequency H, e.g. 13 H. The coupling capacitance Ck is effective between a respective high voltage winding 6 and the primary winding 3. Thus, in toto, a coupling capacitance of $n^{*}Ck$, wherein n is the number of high voltage windings 6 and thus of the chambers 5, is effective between the whole high voltage winding 6 and the primary winding 3. Now, due to the reduced axial length L, the value of n is considerably reduced and thus the total capacitive coupling effective between the high voltage winding 6 and the primary winding 3 is diminished.

FIG. 3 shows a special arrangement of the diodes 7 on the coil former 4. There are four diodes *7a–7d* uniformly distributed over the periphery of the coil former 4 at the same axial position and arranged over the chambers or the walls of the chambers. In this way, e.g. 16 diodes can be accommodated on the coil former 4 in a transformer having the diode arrangement in accordance with FIG. 1 despite the small axial length L of the device.

FIG. 4 shows a solution in accordance with FIG. 3 in which four diodes *7a–7d* i.e. a total of 12 diodes, are arranged over each of three wider chamber walls 14. The number of chambers 5 of the compartmentalized coil former 4 is preferably in the order of magnitude of 6–10. The number of the layers of the primary winding 3 or of the two partial windings is preferably in the order of magnitude of 5–12.

The object of a further development of the invention is to reduce the thermal loading of the diodes and the individual high voltage windings by means of a novel kind of construction of the transformer and without any increase in the dimensions. In accordance with this further development, all of the diodes are arranged on only the two chamber walls at the two ends of the coil former. Preferably these two chambers are only partially filled with winding as compared to the other chambers, e.g. only half-filled or even left completely empty. Since all of the diodes have to be accommodated by only two chamber walls, several diodes, e.g. four, are arranged on one chamber wall and distributed about the periphery.

Because all the diodes are located at the ends of the coil former, but the partial windings of the high voltage winding are distributed over the chambers in the coil former and, because electrically the diodes are located between the partial windings, relatively long leads are needed between the ends of the partial windings and the terminals of the diodes. Consequently, it is not possible to put windings in chambers across which a winding termination has axially crossed. In the normal case, winding terminations of this type must then run over a plurality of chambers that have already been wound. An arrangement of this type can be achieved if, in accordance with a further development of the invention, the chambers succeeding each other in the axial direction of the coil former are wound in such a sequence that the winding wires from one diode, or a point of support, to a chamber are placed over only chambers which have been previously wound. Thereby, the directional sense, in the axial direction in which the individual chambers are successively wound, is formed to be opposite for successive groups of chambers. A winding process of this type is described in the earlier patent application P 41 29 678.

This solution is based on the following considerations. Due to the adjacent location of the high voltage partial windings and the diodes considerable heating of the windings and the diodes occurs. This heating is particularly great in the axial center of the coil former. Consequently, the diodes are placed at the ends of the coil former where the thermal loading is substantially lower. Accordingly, considerable reduction of the thermal loading on the diodes is realized and either the diodes can be driven harder, as regards voltage and current, or cheaper diodes can be utilized, or the breakdown rate of the diodes due to thermal loading is reduced.

This further development is explained in reference to FIGS. 5–7.

FIG. 5 shows the compartmentalized coil former 4 having a plurality of chambers 5 formed by the chamber walls 14 in which partial windings 6 of a high voltage winding are arranged. The coil former 4 holds eight high voltage rectifying diodes 7*a*–7*h*. The diodes 7*a*–7*d* are distributed over the periphery of the chamber wall 14*a* at one end of the coil former 4 and the diodes 7*e*–7*h* are disposed on the chamber wall 14*f* at the other end of the coil former 4. Consequently, all of the chambers or chamber walls 14 located therebetween do not contain any diodes.

FIG. 6 shows that the diodes 7*a*–7*d* are disposed, uniformly distributed over the periphery, on the chamber wall 14*a* of the coil former 4. In a similar manner, the diodes 7*e*–7*h* are arranged on the opposite chamber wall 14*f*.

FIG. 7 shows an enlarged partial sectional illustration the coil former 4 including the chamber walls 14, the two chamber walls 14*a* and 14*f* at the two ends of the coil former 4, the chambers 5, the high voltage partial windings 6*a*–6*h* and the diodes 7. The electrical equivalent circuit diagram, in which a respective diode 7 is located between two partial windings 6, is illustrated in the upper part of the FIG. 7. In the spatial arrangement however, all the diodes 7*a*–7*h* are only located on the two chamber walls 14*a* and 14*f*.

The two chambers 5*a* and 5*h* at the two ends of the coil former 4 are only partially (e.g. half) filled with the partial windings 6*a* and 6*h*. This affords further thermal relief for the diodes 7 because of the increased separation between the diodes and the upper edges of the windings 6*a* and 6*h*. The spacing between the diodes and the next successive partial winding is already sufficient and thermal loading of the diode 7 is not significant.

The object of another development of the invention is to reduce the cost and weight of a high voltage transformer of this type without deteriorating its electro-magnetic properties. This object is achieved in that a ferrite core is formed as a one piece core having open ends of the core legs. A one piece ferrite core which has no narrow air gap between stacked core legs has a relatively large effective air gap and therefore initially appears to be disadvantageous and unsuitable as the high voltage transformer of a television receiver. However, the requirements of a television transformer can be met by appropriate geometrical dimensioning of the core of the coil former. Thus by selecting dimensions such that the ratio of the axial length of the coil former to the outer diameter is distinctly smaller than 1, in contrast to known transformers for requirements are met. It is thereby achieved that the coil former on the core leg occupies a minimum axial length. This is advantageous because, due to the large air gap, the core effect i.e. the inductance of a specific winding on the core, declines sharply towards the open end of the core leg. A sufficiently close approximation to the optimal conditions of a closed core is thereby reached in that, on the one hand, the central core leg carrying the coil former is notably longer than the axial length of the coil former. The length of the core leg located outside the coil former is likewise notably greater than the axial length of the coil former. The length of the core leg located outside the coil former is likewise notably greater than the axial length of the coil former and, if necessary, the length of the central leg is likewise notably greater than the length of the core leg located outside the coil former.

A high voltage transformer having a one piece open core has several advantages. Since there is no defined small air gap between adjoining core legs special polishing of specific surfaces of the core is no longer required. Because of the one piece assembly there is no need for a mechanism for holding two core halves together. The weight of the core and hence of the whole high voltage transformer can be reduced by 15–25%. Despite the absence of a small air gap between the adjoining ends of two core legs, an air gap which is magnetically suitable for a transformer but which mechanically is sufficiently large for the introduction of the coil former can be formed by suitable dimensioning. Measurements have indicated that the stray magnetic field on the outer side of the transformer is substantially smaller than that of known transformers. The transformer does not have a lateral air gap which can generate eddy currents and thus heat losses in adjacent metallic parts such as cooling fins. Moreover, a cheaper ferrite material can be used based upon the fact of the substantially greater air gap than in known transformers. Due to the one part implementation of the ferrite core, further advantages arise when purchasing, storing and handling the core during the manufacture of the high voltage transformer.

There are various possibilities for the implementation of the core. Preferably, the one part open core is formed as an E-core. It may also be formed as a U-core or a pot core. Equally, core shapes may be used which have a central leg having a rounded cross-section for the reception of the coil former and a plurality of core legs for e.g. three relatively displaced from each other by 120° or four relatively displaced by 90°, located on a circle therearound.

In FIG. 8, a ferrite core K has a base leg 20 and two parallel outer legs 15 and 16 having rectangular sections, and a central leg 1 having a rounded cross-section. The complete coil former is arranged on a central leg I. The inner coil supports former 2 auxiliary windings 19 separated by ribs. The windings 19 apply operating voltages or pulses to the picture tube and also heat the tube. A sleeve 17, which forms a smooth winding base for the primary winding 3 wound thereon, is located over the auxiliary windings 19. The compartmentalized coil former 4 including the high voltage winding 6 is located over the coil former 2.

The length of the central leg 1 is greater than the length L of the coil formers 2 and 4 by about 40% to 50%. Moreover, the length of the central leg 1 is about 10% to 20% greater than the length of the outer legs 15 and 16. Furthermore, the ratio of the length L of the coil former to the diameter D of the coil former is made smaller than 1 ($L/D<1$), in practice between approximately 0.6 and 0.9.

The high voltage transformer shown in FIG. 8 having a one part ferrite core does not have a defined small air gap formed by two adjoining core halves, but rather a substantially larger magnetically effective air gap between the central leg 1 and the outer legs 15 and 16. However, it has been found that due to the described dimensioning of the central leg 1, the outer legs 15 and 16 and the dimensions of the coil former 2 and 4 that the desired magnetic properties can be attained. In operation, two effective air gaps in the transformer in accordance with FIG. 8 are connected in parallel, namely, firstly the air gap between the outer leg 15 and the central leg 1 and secondly that between the outer leg 16 and the central leg 1. Due to the dimensioning described, it is achieved that the effective air gap formed between the legs 1, 15, 16 is magnetically sufficiently small for the achievement of the necessary magnetic characteristics of the transformer but, on the other hand, it is mechanically sufficiently large as to be able to place the coil former on the central leg 1.

Because of the open ends of the core legs 1, 15, 16, the inductance of a winding disposed on the central leg 1 sharply declines in the direction towards the open end of the core. If it is assumed that this inductance, e.g. at the cross over point in FIG. 8 between the central leg 1 an the base leg 20, is 100%, then the inductance at the upper end of the coil former would be amount only 40%. This fact, which can be explained by the decline of the magnetic flux through the central leg 1 towards its end, can be utilized to advantage in the following manner. In practice, voltages in the order of magnitude of 5 volts e.g. for the heating of the picture tube are tapped off from a transformer of this type. Only a few turns are needed for such a low voltage. Since only a whole number of turns can ever be realized, the desired voltage sometimes cannot be adhered to exactly. A more exact adjustment of the voltage can now be achieved in that the winding is displaced in the axial direction on the core. Because of the decline of the magnetic flux, the voltage induced in the winding then decreases towards the open end of the core leg 1. By axially displacing the winding on the core 1 or by differing locations of partial windings on the core 1, a winding can then be realized which provides exactly the desired voltage.

FIG. 9 shows a construction of this type. Various partial windings 19*a*–19*b* are arranged at differing axial locations on the coil former 2 between the ribs 18. By means of such a type of distribution of the whole winding and the different axial positioning on the core 1, a full winding having the currently desired voltage can be realized. For respectively equal numbers of turns, the partial winding 19*a* has a substantially lower inductance and hence too a lower induced voltage than the winding 19*b* at the base of the leg. 1.

Figure 10:
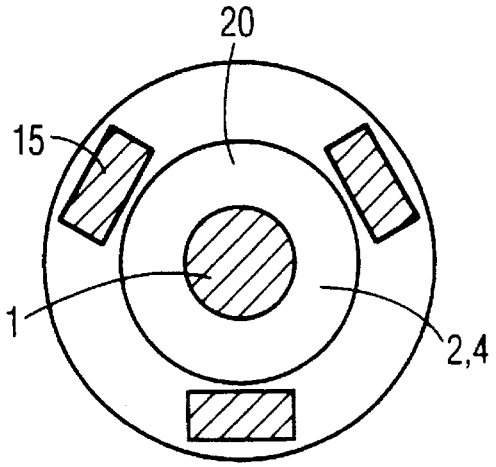

FIG. 10 shows a modification of the shape of the core. Basically, the core is built up in the same way as in FIG. 1 but comprises three outer legs 15 which are displaced by 120°, relative to each other and which are arranged on the now round-shaped base leg 20. The coil former 2, 4 is again inserted between the central leg 1 and the three outer legs 15.

Figure 11:
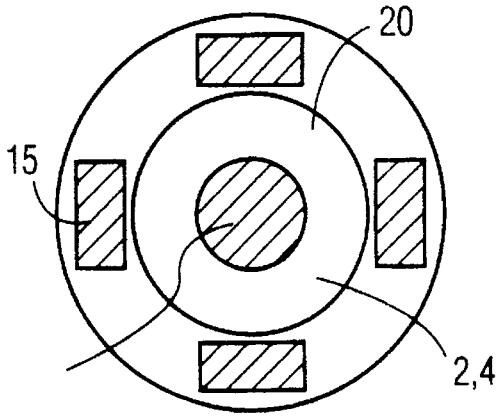

In FIG. 11, the central leg 1 having a rounded cross-section and four outer legs 5 which are displaced by 90° relative to each other and which each have a rectangular cross-section are again arranged on the rounded base leg 20.

Figure 12:
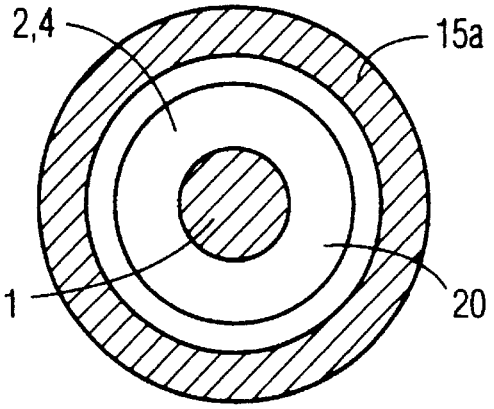

In FIG. 12, the core is formed as a pot core. The outer leg 15*a* then surrounds the central leg 1 in a ring-like manner and forms therewith the pot shaped recess for the reception of the coil former 2, 4.

Figure 13:
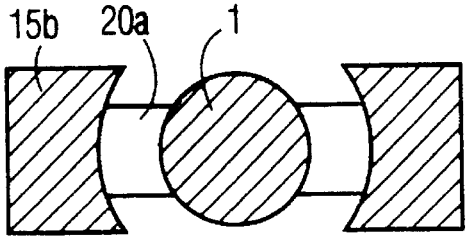

FIG. 13 shows a further shape of the core without a coil former. On the side facing the leg 1, the core legs 15*b* have a rounded section which has a radius such that the spacing between the legs 1 and the leg 15*b* is equal and an optimal screening is achieved. Moreover, the base leg 20*a* joining the legs 1, 15*b* is made smaller than the legs 1 and 15*b* i.e. it has, so to speak, a neck. Thereby, material can be saved and the effective core section is better matched to the effective magnetic field. If the cross-section of the leg 1 is assumed to be 100%, then the legs 15*b* and 20*a* have a cross-section of about 50%. Apart from that, this construction permits an extension of the characteristic curve to be achieved which represents the dependence of the inductance of the winding disposed on the leg on the current flowing through the winding.

Figure 14:
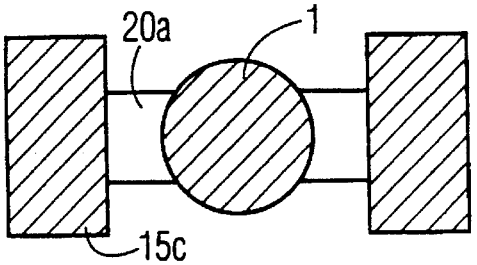

FIG. 14 shows a modification of the core according to FIG. 13 in which merely the legs 15*c* are formed without a rounding i.e. they are square shaped in cross-section.

Due to the indicated decline of the inductance formed towards the open end of the core leg 1, it can happen that two windings which are wound with two or more parallel wires have differing inductances due to the different axial locations of the windings. As a result, undesired transient currents can occur between the two windings. In practice, this can be eliminated by using a so-called slightly twisted wire for these wires. This is a wire that is similar to Litz wire and consists of about 3–5 wires having a relatively large lay of approximately 50 mm. Such a kind of slightly twisted Litz wire is substantially cheaper than a real Litz wire. It has been shown that for a winding having three adjacent parallel wires, the differing inductances of the windings formed from the three wires can be more easily overcome. This applies particularly to the layer-like wound primary winding 3.

What is claimed is:

1. A high voltage transformer for a television apparatus comprising:

a magnetic core;

a coil former mounted about the magnetic core, a primary winding wound upon and supported by the coil former on the magnetic core, said primary winding having an axial length L;

a compartmentalized coil former supporting a high voltage coil wound thereon and circumposed about the primary winding, the high voltage coil having a radial diameter D;

the ratio of the axial length L of the primary winding to the radial diameter D of the high voltage coil being less than one, and a plurality of diodes supported by said compartmentalized coil former and coupled to said high voltage coil, said diodes being supported on said compartmentalized coil former at substantially the same axial position and equally spaced about the periphery of said compartmentalized coil former.

2. The transformer of claim 1 wherein said diodes are supported on at least one end of said coil former.

3. The transformer of claim 2 wherein said primary winding is composed of a plurality of radially superimposed layers arranged about said core.

4. The transformer according to claim 1 wherein the ratio (L/D) is approximately 0.5 to 0.85.

5. The transformer according to claim 1 wherein the primary winding and high voltage coil are poled and distributed in such a way that pulses of approximately the same amplitude and polarity occur in respective portions of the winding and coil facing each other so that the space between the respective portions is virtually free of electrical fields formed between the winding and coil.

6. A high voltage transformer for a television apparatus comprising:

a magnetic core;

a coil former mounted about the magnetic core, a primary winding wound upon and supported by the coil former on the magnetic core, said primary winding having an axial length L and comprised of a plurality of radially superimposed layers arranged about said core;

a compartmentalized coil former supporting a high voltage coil wound thereon and circumposed about the primary winding, the high voltage coil having a diameter D;

the ratio of the axial length L of the primary winding to the radial diameter D of the high voltage coil being less than one, and a plurality of diodes supported by said compartmentalized coil former and coupled to said high voltage coil, said diodes being supported on said compartmentalized coil former at substantially the same axial position on at least one end of said coil former and equally spaced about the periphery of said compartmentalized coil former, means for supporting heating coils arranged between said coil former and said core; and a plurality of heating coils arranged in the means for supporting, said heating coils supplying a heating voltage to a picture tube within said receiver and being axially adjustable on said core to optimize said heating voltage.

7. The transformer of claim 6 wherein respective pluralities of diodes are arranged on the walls of said coil former and at the two ends of said coil former.

8. The transformer of claim 7 wherein said core is a one piece E-shaped core.

9. The transformer of claim 8 wherein said E-shaped core has a central leg having a rounded section supporting said coil former, a plurality of outer legs, and a base leg joining said central leg and said outer legs, said base leg being smaller than said outer legs.

10. The transformer of claim 9 wherein said central leg is substantially longer than said outer legs.

11. A high voltage transformer for a television apparatus comprising:

a magnetic core;

a coil former mounted about the magnetic core, a primary winding wound upon and supported by the coil former on the magnetic core, said primary winding having an axial length L;

a compartmentalized coil former supporting a high voltage coil wound thereon and circumposed about the primary winding, the high voltage coil having a radial diameter D;

the ratio of the axial length L of the primary winding to the radial diameter D of the high voltage coil being less than one, and a plurality of diodes supported by said compartmentalized coil former and coupled to said high voltage coil, said diodes being supported on said compartmentalized coil former at substantially the same axial position and equally spaced about the periphery of said compartmentalized coil former, means for supporting heating coils arranged between said coil former and said core; and a plurality of heating coils arranged in the means for supporting, said heating coils supplying a heating voltage to a picture tube within said receiver and being axially adjustable on said core to optimize said-heating voltage.

12. The transformer of claim 11 said core is E-shaped and wherein said core has a central leg having a rounded section supporting said coil former, a plurality of outer legs, and a base leg joining said central leg and said outer legs, said base leg being smaller than said outer legs.

* * * * *